United States Patent [19]

Jennings, Jr. et al.

[11] Patent Number: 4,756,369

[45] Date of Patent: Jul. 12, 1988

[54] METHOD OF VISCOUS OIL RECOVERY

[75] Inventors: Alfred R. Jennings, Jr., Plano; Edwin T. Strom, Dallas, both of Tex.

[73] Assignee: Mobil Oil Corporation, New York, N.Y.

[21] Appl. No.: 935,355

[22] Filed: Nov. 26, 1986

[51] Int. Cl.[4] ..... E21B 43/24

[52] U.S. Cl. ..... 166/272; 166/273

[58] Field of Search ..... 166/272, 274, 273, 309, 166/303

[56] References Cited

U.S. PATENT DOCUMENTS

| | | | |
|---|---|---|---|
| 3,262,498 | 7/1966 | Connally et al. | 166/273 |
| 3,459,265 | 8/1969 | Buxton et al. | 166/272 |
| 3,838,738 | 10/1974 | Redford et al. | 166/272 |
| 3,927,716 | 12/1975 | Burdyn et al. | 166/270 |
| 4,004,636 | 1/1977 | Brown et al. | 166/272 |
| 4,224,992 | 9/1980 | Comberiati et al. | 166/273 |
| 4,441,555 | 4/1984 | Shu | 166/272 |
| 4,565,249 | 1/1986 | Pebdani et al. | 166/303 |

*Primary Examiner*—Stephen J. Novosad
*Assistant Examiner*—Bruce M. Kisliuk
*Attorney, Agent, or Firm*—Alexander J. McKillop; Michael G. Gilman; Charles A. Malone

[57] ABSTRACT

A process for recovering viscous heavy oil from a substantially shallow reservoir having a low temperature and pressure. Following a steam flood, liquid carbon dioxide is injected into the reservoir where said carbon dioxide remains in its liquid state. Afterwards, a spacer volume of a vaporizable drive fluid is injected into the reservoir behind said carbon dioxide. Subsequently, steam injection is commenced which causes the drive fluid to vaporize and the liquid carbon dioxide to gasify. Vaporization of the drive fluid along with gasification of the carbon dioxide causes a pressure increase in the formation allowing the thinned oil to be removed therefrom.

19 Claims, No Drawings

METHOD OF VISCOUS OIL RECOVERY

FIELD OF THE INVENTION

This invention relates to a process for recovering oil from a subterranean, viscous oil-containing formation. More particularly, this invention relates to a method of recovering oil wherein the oil is displaced from a formation by carbon dioxide in combination with a water drive and steam assist.

BACKGROUND OF THE INVENTION

In the recovery of oil from oil-containing formations, it usually is possible to recover only minor portions of the original oil in-place by the so-called primary recovery methods which utilize only the natural forces present in the formation. Thus, a variety of supplemental recovery techniques have been employed in order to increase the recovery of oil from subterranean formations. These techniques include thermal recovery methods, waterflooding and miscible flooding.

Particularly troublesome is the recovery of viscous oil from oil reservoirs which are relatively shallow. These reservoirs often contain low pressures and low temperatures. Steam flooding is often used to recover viscous oil from these reservoirs. Although cyclic steam flooding may be utilized, often the steam flooding method is insufficient to recover a substantial volume of the viscous oil.

Therefore, what is needed is a method for enhancing the effectiveness of a steamflood operation when recovering viscous oils from relatively shallow reservoirs where the temperatures and pressures are low.

SUMMARY OF THE INVENTION

This invention is directed to a method for recovering viscous oil from a substantially shallow, low temperature, low pressure reservoir. In the practice of this method, steam is injected into at least one wellbore which serves to thin said viscous oil. The thinned oil is produced from at least one production well. Afterwards, liquid carbon dioxide is injected into the formation via an injection well where it remains substantially a liquid because of the low reservoir temperature. Subsequently, a liquid drive fluid capable of being vaporized by steam is injected into the formation via said injection well. Thereafter, steam is injected via said injection well into the formation. Upon contacting said drive fluid, the steam causes the drive fluid to vaporize thereby increasing the pressure in the formation and also causing the carbon dioxide to form a gas. The increased pressure and decreased oil viscosity causes hydrocarbons to be produced from the formation.

It is therefore an object of this invention to cause increased amounts of viscous oil to be produced from a substantially shallow, low temperature, low pressure reservoir.

It is another object of this invention to increase the pressure in situ in a low pressure reservoir.

It is a further object of this invention to increase the efficiency of a steam flood method in a reservoir having a low temperature.

DESCRIPTION OF THE PREFERRED EMBODIMENTS

In carrying out the invention, a subterranean, oil-containing formation is penetrated by at least one injection well and at least one spaced-apart production well in fluid communication with a substantial portion of the formation. The injection and production wells are completed in a conventional manner, such as perforating the wells throughout the full or a substantial amount of the vertical thickness of the oil-containing formation. While recovery of the type contemplated by the present invention may be carried out by employing only two wells, it is to be understood that the invention is not limited to any particular number of wells. The invention may be practiced using a variety of well patterns as is well known in the art of oil recovery, such as an inverted five spot pattern in which an injection well is surrounded with four production wells, or in a line drive arrangement in which a series of aligned injection wells and a series of aligned production wells are utilized. Any number of wells which may be arranged according to any pattern may be applied in using the present method as illustrated in U.S. Pat. No. 3,927,716 to Burdyn et al., the disclosure of which is hereby incorporated by reference. Either naturally occurring or artificially induced fluid communication should exist between the injection well and the production well. Adequate fluid communication may be accomplished by fracturing procedures well known in the art.

This invention can be utilized in a single well technique, known as the "huff and puff" method, as is described in U.S. Pat. No. 4,565,249 issued to Pebdani et al. on Jan. 21, 1986. This patent is incorporated by reference herein. Via this method, the steps below mentioned will be undertaken. Afterwards, the well will be shut-in. Subsequently, the well will be placed on production. After production has declined, the "huff and puff" method may again be employed on the same well to again stimulate production.

In the first step of the invention, a predetermined amount of steam, ranging from 1.3 to 1.8 pore volumes, is injected into the formation via the injection well at an injection rate within the range of 1 to 1.5 barrels of steam (cold water equivalent) per day per acre-foot of formation. By the term "pore volume" as used herein, is meant that volume of the portion of the formation underlying the well pattern employed as described in greater detail in above-mentioned U.S. Pat. No. 3,927,716 to Burdyn et al. Steam temperature is within the range of 450° to 550° F. and a quality of 50% to 90%. The amount of steam injected will vary depending upon the thickness of the formation, oil saturation, viscosity of the oil, porosity of the formation, the amount of water in the formation, and the well pattern.

Once the desired amount of steam has been injected into the formation, liquid carbon dioxide is injected into the formation or reservoir via said injection well. Because the reservoir still retains some heat resultant from said steam flood, the initial amount of liquid carbon dioxide will vaporize to the gaseous state. However, injection of liquid carbon dioxide continues until substantially all the carbon dioxide injected within the formation or reservoir is in its liquid state. This liquid carbon dioxide will tend to remain in its liquid state since the reservoir is substantially shallow and is further characterized in that the temperature is low as well as the pressure. Substantially shallow is defined to mean a depth of from about 500 to about 8000 feet. At these depths, the temperature range will vary from about 50° to about 150° F. Temperature ranges of from about 60° to 90° F. are preferred. Pressures encountered at these depths will vary from 0 psig to about 3000 psig.

When the desired amount of liquid carbon dioxide has been injected into the reservoir, injection of liquid carbon dioxide is ceased. As will be understood by those skilled in the art, the amount of liquid carbon dioxide required will be dictated by the formation's characteristics.

After cessation of the liquid carbon dioxide injection, a spacer volume of a vaporizable drive fluid is injected into the formation via said injection well. The spacer volume of drive fluid is formation or reservoir dependent but should be in an amount sufficient to substantially increase in volume when vaporized by steam. Upon vaporization, said spacer volume should increase the pressure within said reservoir at least two-fold. Increased pressure will enable the production of viscous oils to be increased from the low pressure formation. Vaporizable drive fluids which can be utilized include water, liquified petroleum gas, and butane/butene mixtures. Because it is generally available and inexpensive, water is preferred.

Next, steam injection is again commenced using conditions similar to those employed during the initial steam injection. Since the steam has a temperature of from about 450° to about 550° F., it causes the drive fluid to vaporize and become heated. Vaporization of the drive fluid causes the pressure in the formation to be increased at least two-fold. Heat derived from the vaporized drive fluid, along with the injected steam, transforms the liquid carbon dioxide to its gaseous state, thereby additionally increasing the pressure within the formation or reservoir. The transformation of the liquid carbon dioxide to its gaseous state occurs because its critical temperature (88° F.) is exceeded. This increased pressure further enhances the production of hydrocarbonaceous fluids, including viscous oils, from the reservoir. In its gaseous state, the carbon dioxide is solubilized into the viscous oil thereby causing it to thin and its viscosity to be decreased. The decreased viscosity facilitates the removal of the oil from the formation via the production well. The liquid carbon dioxide, drive fluid, and steam injection steps can be repeated until the desired amounts of hydrocarbonaceous fluids have been removed from the formation.

In another embodiment of this invention, the liquid carbon dioxide is vaporized to its gaseous state continually when injected into a formation where the temperature encountered is substantially above about 88° F. However, the drive fluid and steam injection steps can be utilized as above mentioned. When used in its gaseous state only, the pressures in the formation will not rise as dramatically as when the liquid carbon dioxide is flashed to its gaseous state in situ along with the drive fluid. However, the pressure in a substantially shallow, low pressure reservoir can be increased sufficiently to enhance the recovery of viscous oils from a formation or reservoir containing same. Similarly, the carbon dioxide, drive fluid, and steam injection steps can be repeated until the desired amount of viscous oil has been produced from the reservoir.

Although the present invention has been described with preferred embodiments, it is to be understood that modifications and variations may be resorted to without departing from the spirit and scope of this invention, as those skilled in the art will readily understand. Such modifications and variations are considered to be within the purview and scope of the appended claims.

What is claimed is:

1. A process for recovering viscous oil from a substantially shallow reservoir comprising:

(a) injecting steam into at least one wellbore which steam is sufficient for making the oil less viscous so that it flows to at least one production well;

(b) injecting thereafter liquid carbon dioxide into said formation where a substantial portion of said carbon dioxide remains in its liquid state;

(c) injecting a spacer volume of a vaporizable drive fluid into said reservoir; and (d) injecting steam behind said drive fluid which causes said drive fluid to vaporize and the liquid carbon dioxide to flash to a gaseous phase thereby increasing the pressure in said reservoir and thinning the oil to facilitate its removal from said reservoir by at least one production well.

2. The process as recited in claim 1 where in step (c) said drive fluid comprises water, liquefied petroleum gas, or butane/butene and mixtures thereof.

3. The process as recited in claim 1 where the reservoir pressure is increased at least twice.

4. The process as recited in claim 1 where the reservoir temperature is from about 60° to about 90° F.

5. The process as recited in claim 1 where the wells are placed into the formation to a depth of from about 500 to about 8000 feet.

6. The process as recited in claim 1 where steps (a) through (d) are repeated.

7. A process for recovering viscous oil from a substantially shallow reservoir where following a steam flood oil is produced from said reservoir, the improvement comprising:

(a) injecting after the steam flood liquid carbon dioxide into said formation where a substantial portion of said carbon dioxide remains in its liquid state;

(b) injecting thereafter a spacer volume of a vaporizable drive fluid into said reservoir; and (c) injecting steam behind said drive fluid which causes said drive fluid to vaporize thereby flashing the liquid carbon dioxide to a gaseous phase which causes the reservoir pressure to increase while thinning the oil, thereby facilitating its removal from said reservoir by at least one production well.

8. The process as recited in claim 7 where in step (b) said drive fluid comprises water, liquefied petroleum gas, or butane/butene and mixtures thereof.

9. The process as recited in claim 7 where the reservoir pressure is increased at least twice.

10. The process as recited in claim 7 where the reservoir temperature is from about 60° to about 90° F.

11. The process as recited in claim 7 where the wells are placed into the formation to a depth of from about 500 to about 8000 feet.

12. The process as recited in claim 7 where steps (a) through (c) are repeated.

13. The process as recited in claim 7 where at least one injection and one production well are utilized to remove the thinned oil from said reservoir.

14. The process as recited in claim 7 where one well alone is used for both the injection and the production well to remove the thinned oil from said reservoir.

15. A process for recovering viscous oil from a substantially shallow reservoir having a substantially low reservoir temperature and pressure comprising:

(a) injecting steam into said reservoir which reservoir has a temperature of about 50° to about 150° F. via at least one wellbore which steam is sufficient to make the oil less viscous and flow to at least one production well;

(b) injecting liquid carbon dioxide into the formation until substantially all of said carbon dioxide within said reservoir is in its liquid state;

(c) injecting a spacer volume of a vaporizable drive fluid into said reservoir; and (d) injecting steam behind said drive fluid which causes said drive fluid to vaporize and the liquid carbon dioxide to flash to a gaseous phase thereby increasing the pressure in said reservoir and thinning the oil to facilitate its removal from said reservoir by at least one production well.

16. The process as recited in claim 15 where the reservoir pressure is increased at least twice.

17. The process as recited in claim 15 where the reservoir temperature is from about 60° to about 90° F.

18. The process as recited in claim 15 where the wells are placed into the formation to a depth of from about 500 to about 8000 feet.

19. The process as recited in claim 15 where steps (a) through (d) are repeated.

* * * * *